US005088397A

United States Patent [19]

Mansfield et al.

[11] Patent Number: 5,088,397

[45] Date of Patent: Feb. 18, 1992

[54] CAST FORMED BI-METALLIC WORM ASSEMBLY

[75] Inventors: Peter W. Mansfield, Holmes Beach, Fla.; Frank N. Dupps, Germantown, Ohio

[73] Assignee: The Dupps Co., Germantown, Ohio

[21] Appl. No.: 640,246

[22] Filed: Jan. 11, 1991

[51] Int. Cl.[5] ..... B30B 3/00

[52] U.S. Cl. ..... 100/145; 198/677; 228/131; 228/135; 228/254; 366/322; 425/208; 464/182

[58] Field of Search ..... 100/93 S, 117, 126, 100/127, 145-150; 366/322, 90; 198/676, 677; 425/208; 228/131, 135, 254; 464/182

[56] References Cited

U.S. PATENT DOCUMENTS

| | | | |
|---|---|---|---|
| 2,145,168 | 1/1939 | Flagg | 228/135 |
| 2,364,109 | 12/1944 | Taylor | 228/135 X |
| 2,544,302 | 3/1951 | Duncan | 228/135 X |
| 2,976,702 | 3/1961 | Pietsch | 464/182 X |
| 3,008,310 | 11/1961 | Bastow et al. | 464/182 X |
| 3,025,596 | 3/1962 | Ward et al. | 228/131 |
| 3,069,873 | 12/1962 | Whitlock | 100/145 X |
| 3,290,772 | 12/1966 | Crouch | 228/135 |
| 3,310,836 | 3/1967 | Nichols | 100/93 S X |
| 3,633,266 | 1/1972 | Taylor | 228/254 X |
| 4,223,601 | 9/1980 | Knuth et al. | 100/117 |
| 4,838,700 | 6/1989 | Williamson | 100/117 X |

FOREIGN PATENT DOCUMENTS

| | | | |
|---|---|---|---|
| 933185 | 9/1955 | Fed. Rep. of Germany | 100/145 |
| 52921 | 12/1966 | Fed. Rep. of Germany | 100/145 |

*Primary Examiner*—Harvey C. Hornsby
*Assistant Examiner*—Stephen F. Gerrity
*Attorney, Agent, or Firm*—Charles J. Prescott

[57] ABSTRACT

A cast-formed bi-metallic worm assembly of a mechanical screw press for expressing liquids from fibrous materials and a method of manufacture therefor. The worm assembly is rotatably driven by the press drive shaft and includes an outer flight body having an integral outwardly extending helical flight formed of a relatively brittle, wear-resistant homogeneous cast material and an inner hub tightly fitted and substantially fully mated within, and coextensive with, the outer flight body. The inner hub, cast formed of a more ductile, tougher homogeneous material, includes a hollow cylindrical interior surface structured for slidable engagement around and in driving connection with the drive shaft. The inner hub and outer flight body are securely engaged one to another by a very thin layer of bonded brazing compound over substantially the entire mating surface therebetween. The method of manufacturing helps insure very close mating surface contact to enhance the strength of brazing. Longitudinal lobes in a clover leaf cross sectional pattern further increases rotational or torsional strength of the worm assembly without appreciably increasing internal operating stress between inner hub and flight body.

4 Claims, 2 Drawing Sheets

CAST FORMED BI-METALLIC WORM ASSEMBLY

BACKGROUND OF THE INVENTION

This invention relates generally to screw presses for expressing fluids from fibrous materials, and more particularly to a bi-metallic worm assembly for use in conjunction with such presses.

The flights on worm assemblies which radially extend from the flight body of feed screws of high pressure expressing presses incur substantial wear and abusive interaction with both fibrous material and debris contained therein as they interact with the walls of the screw press. It is a well-known technique to provide wear resistant or hardfacing coatings upon the surfaces of the flight and flight body which are subjected to highest wear. Techniques utilized for this purpose are deposit welding, flame spray deposition, plasma deposition and the like. Thereafter, the surfaces are smoothed manually back to the desired dimension of the flight. These conventional deposit welding techniques are labor intensive, require expensive components, and provide poor bonding between the ductile base material and the harder deposited weld material.

Considerable effort has been expended to resolve this wear problem as described in the following U.S. and foreign patents known to applicant which include some combination of bi-metallic structure:

French—U.S. Pat. No. 3,592,128,
Bredeson—U.S. Pat. No. 3,980,013,
Knuth, et al.—U.S. Pat. No. 4,223,601,
Theysohn—U.S. Pat. No. 4,364,664,
Mansfield—U.S. Pat. No. 4,440,076,
Zies—U.S. Pat. No. 3,034,424,
French, et al.—U.S. Pat. No. 3,721,184,
Mansfield—U.S. Pat. No. 4,996,919,
Williamson—U.S. Pat. No. 4,838,700,
- - - —U.K. 592,834,
- - - —Italy 557,425,
Appleby—U.K. 310,680.

Several attempts have also been made to produce a homogeneous feed screw by utilizing casting techniques. However, if a highly wear resistant brittle material is chosen, cracking at the keyway or other highly stressed areas occurs. Alternately, where a more ductile material is used, premature wear of the flight is experienced.

Applicant has also invented another form of a bi-metallic feed screw as described in his co-pending application, Ser. No. 07/411,191 filed Oct. 19, 1989, now U.S. Pat. No. 4,996,919. However, this invention is directed to the mechanical engagement of a flight within a mating cavity formed the flight body itself.

The present invention utilizes the techniques of brazing and heat expansion and shrinkage to interconnect the relatively soft and tough inner hub within a worm flight cast formed of harder material such as STELLITE and a method of manufacture therefor. This structure is ideally suited for high wear resistance, minimum internal stress risers and maximized inner hub toughness and ductility.

BRIEF SUMMARY OF THE INVENTION

This invention is directed to a cast-formed bi-metallic worm assembly of a mechanical screw press for expressing liquids from fibrous materials and a method of manufacture therefor. The worm assembly is rotatably driven by the press drive shaft and includes an outer flight body having an integral outwardly extending helical flight formed of a relatively brittle, wear-resistant homogeneous cast material and an inner hub tightly fitted and substantially fully mated within, and coextensive with, the outer flight body. The inner hub, cast formed of a more ductile, tougher homogeneous material, includes a hollow cylindrical interior surface structured for slidable engagement around and in driving connection with the drive shaft. The inner hub and outer flight body are securely engaged one to another by a very thin layer of bonded brazing compound over substantially the entire mating surface therebetween. The method of manufacture helps insure very close mating surface contact to enhance the strength of brazing. Longitudinal lobes in a clover leaf cross sectional pattern further increase rotational or torsional strength of the worm assembly without appreciably increasing internal operating stress between inner hub and flight body.

It is therefore an object of this invention to provide a bi-metallic worm assembly for screw presses which is fabricated using conventional casting techniques and having a flight body formed of harder, wear-resistant material and an inner hub formed of more ductile, softer and tougher material.

It is another object of this invention to provide a bi-metallic worm assembly for screw presses which is reliant upon the mechanical brazing compound bonding between inner hub and outer flight body for torsional strength and rigidity.

It is yet another object of this invention to provide a method of manufacturing a highly wear-resistant bi-metallic worm assembly for screw presses.

It is yet another object of this invention to provide a reusable bi-metallic worm assembly wherein the outer flight body may be separated from the inner hub for remelting of the harder flight body material, and recycling of the inner hub, which is typically not in need of repair or replacement and may be reused.

In accordance with these and other objects which will become apparent hereinafter, the instant invention will now be described with reference to the accompanying drawings.

DETAILED DESCRIPTION OF THE INVENTION

Figure 1:
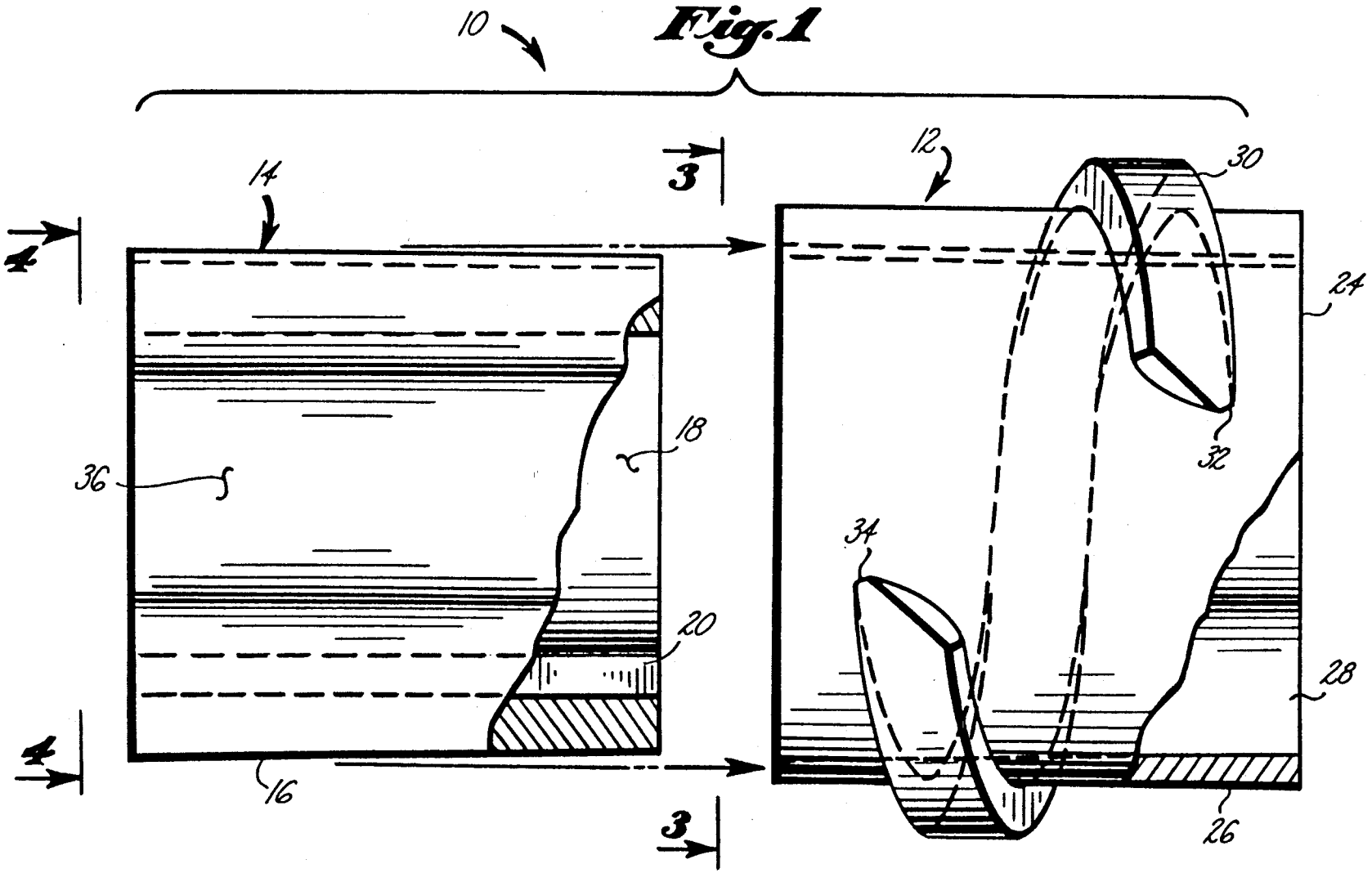
FIG. 1 is an exploded side elevation view of the present invention.
Figure 2:
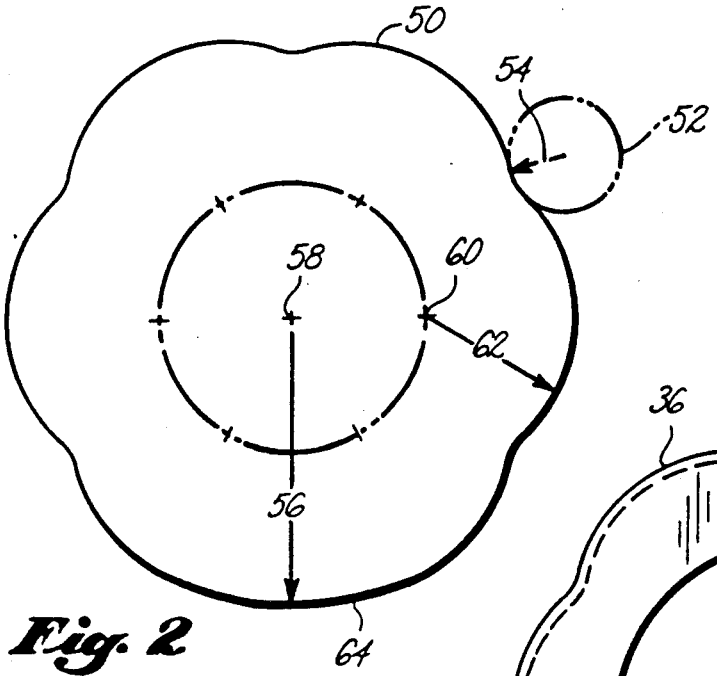
FIG. 2 is a schematic view of the cross sectional profile between the outer flight body and the inner hub.
Figure 4:
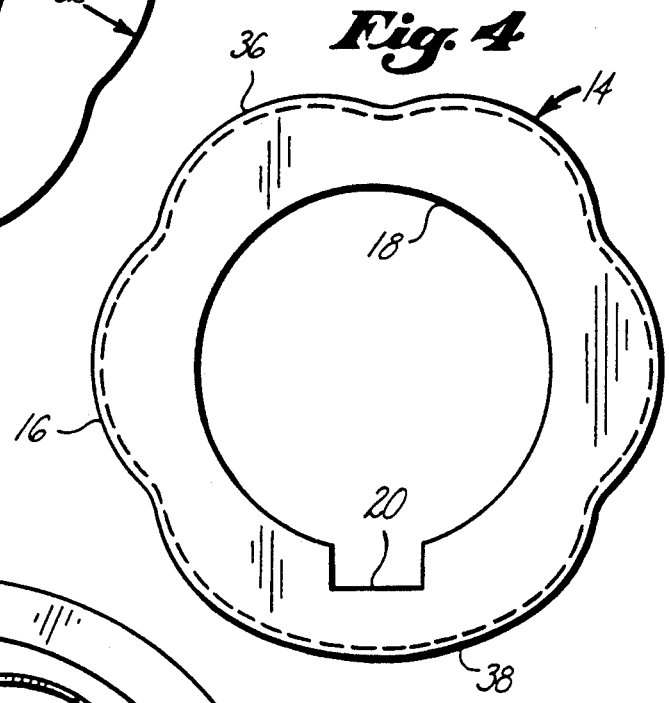
FIG. 4 is an end view of the inner hub in the direction of arrows 4—4 in FIG. 1.
Figure 3:
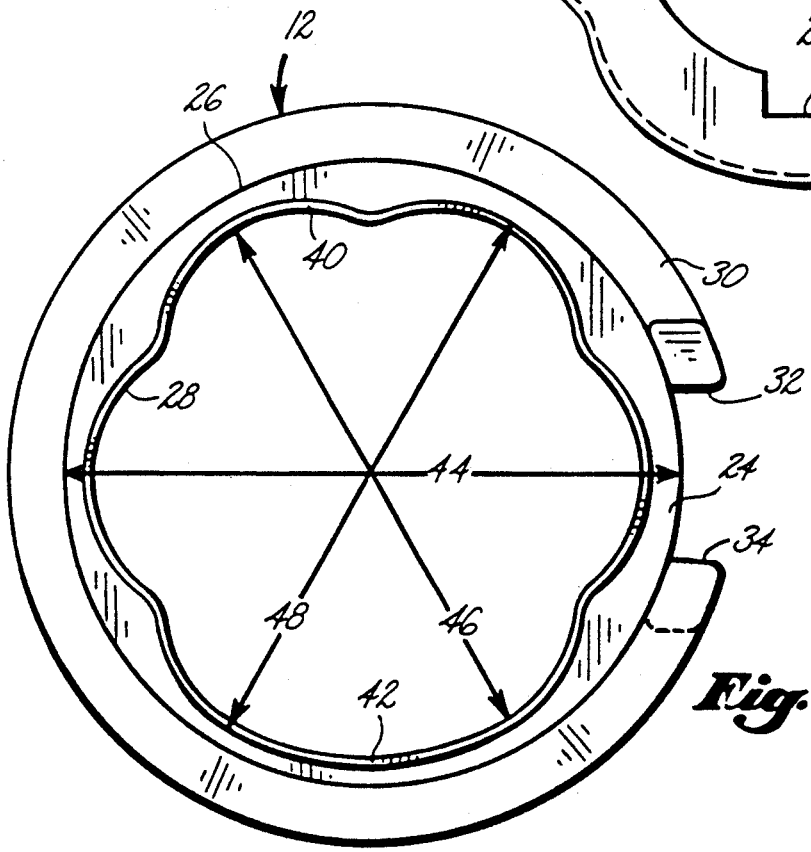
FIG. 3 is an end view of the flight body in the direction of arrows 3—3 in FIG. 1.

Referring now to the drawings, and particularly to FIGS. 1, 3 and 4, the invention is shown generally at numeral 10 and includes an outer flight body 12 and an inner hub 14. The outer flight body 12 is cast formed of a hard, brittle material such as high cobalt, nickel or chrome steel also known as STELLITE. The flight body 12 includes a main cylindrical hollow body portion 26 and an integral radially outwardly extending helical flight 30 which extends almost fully around the body portion between flight ends 32 and 34. The cylindrical interior surface 28 is tapered at approximately 1° taper toward end 24 having a lobed or clover leaf cross sectional profile which is described more fully with respect to FIG. 2 herebelow.

The inner hub 14 is cast formed of a second, more ductile homogeneous material such as mild 1015-1020 steel or series 300 stainless steel having a cylindrical outer surface 16 which is closely identical to interior surface 28 of flight body 12, which includes a taper of approximately 1° and lobed or cloverleaf cross section which will be described herebelow. The interior cylindrical hollow surface 18 of inner hub 14 is circular in cross section, except for keyway 20 which provides for slidable engagement over the drive shaft and longitudinal key of the screw press (not shown).

Although the closely mating interior surface 28 of flight body 12 and the exterior surface 16 of inner hub 14 may be machine fit, applicant has found that, through investment casting and the method of manufacture described herebelow, investment-cast mating surfaces are of sufficiently close tolerance so as to satisfy the needs of the present invention.

A layer of nickel base brazing compound is bonded by liquefying the brazing compound between substantially the entire mating surfaces between the inner hub 14 and the outer flight body 12 so as to secure the axial relationship one to another and to absorb all of the significant torsional or sheer loading which will be placed on this surface during use of the present invention.

Referring now to FIG. 2, the preferred clover leafed or lobed cross sectional profile is there shown schematically at 50. The shape or profile of cylindrical surface generally includes at least one longitudinal lobe having a smooth, uniform cross sectional shape along the entire length of the worm assembly 10. This profile 50 is generated by the combination of a circular periphery having radius 56 about center 58, a total of five adjacent arcuate lobes having radius 62 about points 60 which are evenly spaced at 60° one to another and a blend radius 54 as a segment of circle 52 shown in phantom. To insure positive rotational alignment and to provide additional material around keyway 20, one of the lobes 56 is enlarged and extends over a span of approximately 120°. This profile 50 is provided so as to increase the surface contact area between the interior surface 28 of worm flight 12 and the exterior surface 16 of inner hub 14 and to provide interlocking mechanical strength therebetween while minimizing any stress risers under torsional loading as a result of the smooth lobed undulation.

One example of dimensions 44, 46, and 48 in FIG. 3 is as follows:

| | |
|---|---|
| #44 | 8.50" DIA |
| #46 | 7.482" DIA |
| #48 | 7.750" DIA |

METHOD OF MANUFACTURE

The method of manufacture of the present invention as previously described includes first cast forming the flight body 12 of a brittle steel material such as STELLITE. If desired, although not preferred, the interior surface 28 may be machined to achieve a more precise fit over the exterior cylindrical surface 16 of inner hub 14. The inner hub 14 is also cast formed of a more ductile, softer and tougher homogeneous material such as mild steel. Likewise, this exterior surface 16 may be machine formed but it is believed that the cast surface is sufficiently accurate for the purposes of the present invention.

However, to further insure the accurate mating of the respective cast surfaces 28 and 16, the inner hub 14 is preferably cast formed utilizing a wax mold produced from the same core used to produce the inside configuration of the flight body 12.

The inner hub 14 then receives a coating of nickel based brazing compound over the entire exterior surface 16. This is applied preferably by an electroless plating process, but it may also be applied using conventional spraying or painting techniques. Thereafter, the flight body 12 is heated to a uniform temperature just below the plastic temperature of the cast material thereof. This is typically in the range of 1500° F. for STELLITE. The inner hub 14 coated with brazing compound is then inserted fully and matingly within the flight body 12, which insertion assembly is facilitated by the thermal expansion of the flight body material due to the elevated temperature thereof.

Although not a required step, it is preferred that the now assembled components be elevated to a temperature just below the melting temperature of the brazing compound, 1830° F. of the preferred brazing compound, or about 1750° F., the lower plastic temperature of STELLITE. This intermediate heating of the assembled components is desired so as to elevate the temperature of inner hub 14 to equal that of the flight body prior to liquefying the brazing compound. It is noted that the plastic temperature of the ductile hub 14 is about 2300° F., or well above the temperature utilized in the present invention.

The assembled components are then further heated to approximately 1830° F., the temperature at which the preferred brazing compound becomes liquid. Holding the components at this temperature momentarily, (for approximately 15 minutes) then insures that the brazing compound fully flows and bonds between the entire mating contact surfaces 16 and 28.

Thereafter, the assembled components are brought down to a temperature of approximately 1500° for a period of two hours or for the prescribed about of time for fully annealing the STELLITE material or its substitute utilized in casting the flight body 12. Thereafter, the worm assembly 10 is cooled slowly to room temperature over a period of eight hours.

It is important to note that the temperature of the brazing compound (preferably 1830° F.) is selected to be slightly above the plastic temperature of the material used in the flight body 12. This is to insure that the highest degree of surface contact, if not virtually total contact, is achieved between the inner hub 14 and the outer flight body 12. Because of its unique initial temperature of plasticity (approximately 1750° F.), a nickel-chrome-boron (2–4%) allowed under the trade designation Alloy 45" by Stoody-Deloro Stellite Corp. is preferred for use in cast forming the flight body 12. Thus, as the assembly is cooled from the maximum temperature of 1830° F. wherein the brazing compound liquifies and flows, the plasticity of the flight body 12 is such as to fully conform around the inner hub 14 as further cooling occurs. Any hoop stress which may result from the mismating is relieved by the step of the annealing thereafter. Thus, a fully stress-free worm assembly 10 is achieved when final cooling at room temperature is completed.

Although no taper of the cylindrical mating surfaces 18 and 28 is required, it has been found that a 1% mating taper enhances the closeness of the final fit between the inner hub and outer flight body. Additionally, it is preferred to heat the components in an inert gas or reducing atmosphere rather than air.

Although the preferred embodiment and use of the present invention is as above described, the method of this invention is equally applicable to bi-metallic structures having a hard, wear-resistant inner hub and tough, ductile outer cylindrical member such as is required in plastic extruders for injection molding equipment.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A cast formed bi-metallic worm assembly in a mechanical screw press having a rotary drive shaft in driving engagement with said worm assembly comprising:

an inner hub having a uniform cylindrical outer surface and a hollow interior surface structured for slidable engagement around and in driving communication with the drive shaft, said inner hub formed of a first rigid homogeneous cast material;

a flight body having a uniform cylindrical inner surface closely mated with, and in tight gripping relationship around and over substantially the entire length of, said inner hub outer surface, said flight body also having an integral helical flight extending radially therefrom, said flight body formed of a second rigid homogeneous cast material;

said second cast material harder than said first cast material;

said flight body inner surface in rotational driving engagement with said inner hub outer surface held thusly only by a layer of bonded braze welding between substantially the entire mating surfaces of said flight body and said inner hub;

said mating inner and outer cylindrical surfaces including at least one longitudinal lobe having a smooth, uniform cross sectional shape along the entire length of said worm assembly for increased rotational driving engagement between said inner hub and said flight body.

2. A cast formed bi-metallic worm assembly as set forth in claim 1, wherein:

said inner and outer surfaces are slightly tapered longitudinally.

3. A cast formed bi-metallic worm assembly as set forth in claim 1, wherein:

said second cast material is a nickel-chrome-boron alloy.

4. A cast formed bi-metallic worm assembly in a mechanical screw press having a rotary drive shaft in driving engagement with said worm assembly comprising:

an inner hub having a uniform cylindrical outer surface and a hollow interior surface structured for slidable engagement around and in driving communication with the drive shaft, said inner hub formed of a first rigid homogeneous cast material;

a flight body having a uniform cylindrical inner surface closely mated with, and in tight gripping relationship around and over substantially the entire length of, said inner hub outer surface, said flight body also having an integral helical flight extending radially therefrom, said flight body formed of a second rigid homogeneous cast material;

said second cast material harder than said first cast material;

said flight body inner surface in rotational driving engagement with said inner hub outer surface held thusly only by a layer of bonded braze welding between substantially the entire mating surfaces of said flight body and said inner hub;

said mating inner and outer cylindrical surfaces include a plurality of longitudinal lobes having a smooth, uniform cross sectional shape along the entire length of said worm assembly for increased rotational driving engagement between said inner hub and said flight body.

* * * * *